US010005306B2

(12) United States Patent
Kimura et al.

(10) Patent No.: US 10,005,306 B2
(45) **Date of Patent: *Jun. 26, 2018**

(54) THERMOSENSITIVE RECORDING BODY

(71) Applicant: OSAKA SEALING PRINTING CO., LTD., Osaka-shi, Osaka (JP)

(72) Inventors: Takayuki Kimura, Osaka (JP); Masahiko Yoshida, Osaka (JP)

(73) Assignee: Osaka Sealing Printing Co., Ltd., Osaka (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/325,806

(22) PCT Filed: Jul. 14, 2014

(86) PCT No.: PCT/JP2014/003726

§ 371 (c)(1),
(2) Date: Jan. 12, 2017

(87) PCT Pub. No.: WO2016/009462

PCT Pub. Date: Jan. 21, 2016

(65) Prior Publication Data

US 2017/0165992 A1 Jun. 15, 2017

(51) Int. Cl.

| | |
|---|---|
| ***B41M 5/337*** | (2006.01) |
| ***B41M 5/44*** | (2006.01) |
| ***B41M 5/327*** | (2006.01) |
| ***B41M 5/333*** | (2006.01) |

(52) U.S. Cl.

CPC ..... *B41M 5/3372* (2013.01); *B41M 5/3275* (2013.01); *B41M 5/3336* (2013.01); *B41M 5/3377* (2013.01); *B41M 5/44* (2013.01); *B41M 2205/04* (2013.01); *B41M 2205/38* (2013.01); *B41M 2205/40* (2013.01)

(58) Field of Classification Search

CPC .. B41M 3/337; B41M 3/3372; B41M 3/3375; B41M 3/3377; B41M 5/42; B41M 5/44; B41M 2205/04; B41M 2205/38; B41M 2205/40; B41M 5/337; B41M 5/3372; B41M 5/3375; B41M 5/3377; B41M 2205/0438

USPC ..... 503/200, 208, 226

See application file for complete search history.

(56) References Cited

U.S. PATENT DOCUMENTS 6,921,740 B1 * 7/2005 Hizatate ..... B41M 5/3333 503/200

FOREIGN PATENT DOCUMENTS

| | | | | |
|---|---|---|---|---|
| JP | H04-325287 A | | 11/1992 | |
| JP | H06-227124 A | | 8/1994 | |
| JP | H08-025807 A | | 1/1996 | |
| JP | 8-156406 A | | 6/1996 | |
| JP | H10-251591 A | | 9/1998 | |
| JP | 11-099749 | * | 4/1999 | ..... B41M 5/26 |
| JP | H11-165464 A | | 6/1999 | |

(Continued)

*Primary Examiner* — Bruce H Hess

(74) *Attorney, Agent, or Firm* — Norris McLaughlin & Marcus, P.A.

(57) ABSTRACT

A thermosensitive recording body has at least a thermosensitive recording layer and a topcoat layer formed on a substrate. The substrate consists of a transparent film. At least the thermosensitive recording layer and the topcoat layer includes a diffuse reflection suppressor component that suppresses diffuse reflection of light from particles constituting the thermosensitive recording layer and the topcoat layer.

12 Claims, 1 Drawing Sheet

(56) References Cited

FOREIGN PATENT DOCUMENTS

| | | | |
|---|---|---|---|
| JP | 2001-353964 | A | 12/2001 |
| JP | 2002-362027 | A | 12/2002 |
| JP | 2005-40989 | A | 2/2005 |
| JP | 2010-23252 | A | 2/2010 |
| WO | 2011/027752 | A1 | 3/2011 |
| WO | 2015/012386 | A1 | 1/2015 |
| WO | 2015/072410 | A1 | 5/2015 |
| WO | 2015/072411 | A1 | 5/2015 |

* cited by examiner

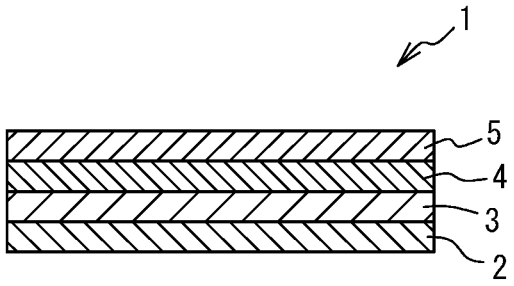
1
5
4
3
2

THERMOSENSITIVE RECORDING BODY

BACKGROUND OF THE INVENTION

This invention relates to a thermosensitive recording body, more particularly to a thermosensitive recording body that may excel in transparency.

Thermosensitive recording bodies are for use in image recording by having their colors developed through chemical reactions initiated by heating a thermal head. The thermosensitive recording bodies are used in a broad range of applications. For example, they may be used as recording media for facsimile machines, vending machines, and scientific instrumentation devices, and may also be used as thermosensitive recording labels for POS systems in retail stores (for example, Japanese Unexamined Patent Publication No. 2002-362027).

Related prior art is Japanese Unexamined Patent Publication No. 2002-362027.

SUMMARY OF THE INVENTION

In the meantime, the thermosensitive recoding bodies may be further used as labels or packaging films for containers packed with various kinds of foodstuffs. The labels and films using the thermosensitive recoding bodies, however, may conceal the contents of the containers, making it difficult for the consumers to check the contents of the containers.

The labels or films using the thermosensitive recoding bodies, therefore, should desirably be transparent to see what is inside the containers. However, none of the conventional thermosensitive recording bodies is transparent enough to serve the purpose.

To address this issue, this invention is directed to providing a thermosensitive recording body that may excel in transparency.

A thermosensitive recording body according to this invention is characterized as described below.

The thermosensitive recording body according to this invention has at least a thermosensitive recording layer and a topcoat layer formed on a substrate. The substrate consists of a transparent film. At least the thermosensitive recording layer and the topcoat layer include a diffuse reflection suppressor component that suppresses diffuse reflection of light from particles constituting the thermosensitive recording layer and the topcoat layer.

In the thermosensitive recording body according to this invention, at least the thermosensitive recording layer and the topcoat layer formed on the substrate consisting of a transparent film each include the diffuse reflection suppressor component that suppresses the diffuse reflection of light from the particles constituting these layers. In the layers including this component therefore, the diffuse reflection of light from the particle surfaces may be effectively suppressed. As a result, the thermosensitive recording body finally obtained may excel in transparency.

According to an aspect of this invention, the thermosensitive recording body, exclusive of the substrate, has a thickness greater than or equal to 1.0 μm and less than or equal to 10 μm, and the thermosensitive recording body has an opacity less than or equal to 10% pursuant to Japanese Industrial Standards (JIS): P8138.

In this aspect, the opacity of the thermosensitive recording body according to JIS: P8138 is less than or equal to 10%. When the thermosensitive recording body is bonded to a container as a label or a packaging film, therefore, the contents of the container may be visually observed through the label or film.

According to another aspect of this invention, the thermosensitive recording layer includes a low-melting paraffin having a melting point lower than or equal to a color developing temperature as the diffuse reflection suppressor component.

In this aspect, the low-melting paraffin added as the diffuse reflection suppressor component is melted in the process of spreading and drying a liquid material prepared for the thermosensitive recording layer on the substrate. The melted paraffin penetrates into and fills gaps such as angularities of the surfaces of the particles constituting the thermosensitive recording layer. This may suppress the diffuse reflection of light from the particle surfaces, affording an improved transparency.

According to yet another aspect of this invention, the thermosensitive recording body further includes an intermediate layer between the thermosensitive recording layer and the topcoat layer. The intermediate layer includes a resin containing a water-soluble portion as the diffuse reflection suppressor component.

In this aspect, the intermediate layer includes a resin containing a water-soluble portion. In the process of spreading and drying a liquid material prepared for the intermediate layer on the thermosensitive recording body, therefore, the resin containing a water-soluble portion sinks into the thermosensitive recording layer, allowing the intermediate layer formed to improve in smoothness. This technical feature may effectively suppress the diffuse reflection of light from the thermosensitive recording layer, delivering a further improved transparency.

According to yet another aspect of this invention, the resin containing a water-soluble portion is a polyvinyl alcohol resin.

The water-soluble polyvinyl alcohol resin used in this aspect has favorable film formation properties. By using this material, the intermediate layer improved in smoothness may be formed on the thermosensitive recording layer. This may suppress that the diffuse reflection of light from the thermosensitive recording layer, affording improved transparency.

According to yet another aspect of this invention, the resin containing a water-soluble portion is a core-shell type resin.

In this aspect using the core-shell type resin, the water-soluble shells may serve the purpose of forming the intermediate layer improved in smoothness, delivering a higher transparency. Further, the hydrophobic core of this resin may prevent the risk of degrading waterproofness.

According to yet another aspect of this invention, the topcoat layer contains a colloidal silica as the diffuse reflection suppressor component.

The colloidal silica has smaller particle sizes than other usable fillers of the topcoat layer such as calcium carbonate and organic fillers, effectively suppressing the diffuse reflection of light.

In the thermosensitive recording body according to this invention, at least the thermosensitive recording layer and the topcoat layer are formed on the substrate consisting of a transparent film, and the thermosensitive recording layer and the topcoat layer each include the diffuse reflection suppressor component that suppresses the diffuse reflection of light from the particles constituting these layers. This technical feature may effectively suppress the diffuse reflection of light from the particle surfaces. As a result, the thermosensitive recording body finally obtained may excel in transparency.

BRIEF DESCRIPTION OF THE DRAWING

The drawing is a schematic cross-sectional view of a thermosensitive recording body according to an embodiment of this invention.

DETAILED DESCRIPTION OF THE INVENTION

An embodiment of this invention is hereinafter described in detail referring to the accompanying drawing.

As illustrated in the drawing, a thermosensitive recording body 1 according to this embodiment has a structure in which a thermosensitive recording layer 3 color-developed by heating, an intermediate layer 4, and a topcoat layer 5 are formed in a stacked configuration on a substrate 2 in the form of a sheet.

Examples of materials of the substrate 2 may include transparent synthetic resin films such as polypropylene films, polyethylene terephthalate films, polystyrene films, and polycarbonate films. Though the film selected from these examples may have an optional thickness, examples of the thickness may range from approximately 10 μm to 100 μm in view of better coating properties and higher transparency.

Examples of materials of the thermosensitive recording layer 3 may include colorants color-developed by heating, developers, fillers, binders, and lubricants.

To improve the thermosensitive recording layer in transparency, the materials used may preferably have smaller particle sizes. The finer particles of the materials may more effectively suppress the diffuse reflection of light from the particles.

Specific examples of leuco dyes usable as the colorant may include 2-aniline-3-methyl-6-(N-methyl-P-toluidine) fluorans, particle sizes of which may preferably be between 0.1 μm and 1.0 μm. The "particle size" is generally defined as a 50% median particle size measured by microtrac laser analysis or scattering particle size analysis.

Likewise, the "particle size" in this description refers to a 50% median particle size measured by microtrac laser analysis or scattering particle size analysis.

Examples of the developers may include 3,3'-diaryl-4,4'-dihydroxydiphenyl sulfones, particle sizes of which may preferably be between 0.1 μm and 1.0 μm.

Examples of the fillers may include kaolin and calcium carbonate, particle sizes of which may preferably be less than or equal to 1.0 μm.

Examples of the binders may include styrene-butadiene copolymers.

Examples of the lubricants may include polyethylene, zinc stearate, and paraffins, particle sizes of which may preferably be less than or equal to 0.5 μm The paraffins may be effectively useful for enhancing the transparency, and a low-melting paraffin is particularly preferable. The low-melting paraffin may have a melting point lower than the color developing temperature of the thermosensitive recording layer 3, preferably lower than 80° C., or more preferably lower than 50° C.

The low-melting paraffin may preferably have particle sizes less than or equal to 0.5 μm. The content of the paraffin may preferably be between 0.1 and 1.0 g/m$^2$ by dry weight.

In the process of spreading and drying a liquid material prepared for the thermosensitive recording layer 3 on the substrate 2, the low-melting paraffin is melted. The melted paraffin then penetrates into and fills gaps such as irregularities of the surfaces of the particles constituting the thermosensitive recording layer 3. This may suppress the diffuse reflection of light from the particle surfaces, affording an improved transparency.

The intermediate layer 4 has barrier properties against water and oil and primarily consists of a resin.

Examples of the resin used for the intermediate layer 4 may include acrylic resin emulsions, water-soluble resins such as polyvinyl alcohol (PVA) resins, and SBR resins.

To enhance the transparency, the resin may preferably be a resin containing a water-soluble portion, for example, a polyvinyl alcohol (PVA) resin containing a hydroxy group as a hydrophilic structural unit, or a core-shell type resin having hydrophobic core particles coated with a water-soluble shell polymer. Typical examples of the core-shell type resin may include core-shell type acrylic resins.

The water-soluble polyvinyl alcohol (PVA) resins and core-shell type acrylic resins have favorable film formation properties. In the process of spreading and drying a liquid material prepared for the intermediate layer on the thermosensitive recording layer 3, the resin containing a water-soluble portion sinks into the thermosensitive recording layer 3, allowing the intermediate layer 4 formed to improve in smoothness. This may suppress the diffuse reflection of light from the thermosensitive recording layer 3, affording an improved transparency.

The core-shell type resins are known materials. Examples of the core-shell type acrylic resins may include a commercially available product known by the trade name, BARIASTAR (Mitsui Chemicals, Inc.).

The topcoat layer 5 improves the head-matching properties of the thermosensitive recording body 1 to the thermal head, thereby assisting in successful color development of the thermosensitive recording layer 3. The topcoat layer 5 is prepared by adding a filler, a lubricant, a cross-linking agent to a binder, etc.

Examples of the binder may include acrylic resins.

Examples of the lubricant may include polyethylene and zinc stearate.

Examples of the cross-linking agent may include zirconium carbonate.

Examples of the filler may include colloidal silica, calcium carbonate, polymethyl methacrylate (PMMA), and polystyrene (PS).

The filler selected and used may preferably have particle sizes less than or equal to 1.0 μm.

The filler may preferably be colloidal silica having small particle sizes for a better transparency.

The thickness in total of the thermosensitive recording layer 3, the intermediate layer 4, and the topcoat layer 5 made of such materials is not particularly limited, meaning that the thickness of the sheet-like thermosensitive recoding body 1, exclusive of the substrate 2, may have an optional thickness. For instance, the thermosensitive recoding body 1 greater than or equal to 1.0 μm in thickness has an opacity less than or equal to 10%. This opacity is determined pursuant to JIS: P8138 that sets forth the testing method for opacity of paper.

This invention is hereinafter described in further detail based on working examples.

To begin with, the inventor discussed, through tests, effective compositions of the thermosensitive recording layer 3, the intermediate layer 4, and the topcoat layer 5 for improvements of the transparency.

As the substrate 2 were used OPP (biaxially oriented polypropylene) films having the thickness of 40 μm.

The opacity of the OPP films pursuant to JIS: P8138 was 2.0%.

This opacity was measured by the reflectometer, "TC-6DS/A", supplied by Tokyo Denshoku CO., LTD.

[Discussed Compositions of the Thermosensitive Recording Layer]

Four different liquid materials for the thermosensitive recording layer were prepared, as shown with No. 1 to No. 4 in Table 1. The liquid materials were respectively spread on the OPP film so as to have the dry weight of 4.0 g/m$^2$, and then dried to obtain different thermosensitive recording layers.

TABLE 1

| | | Developer | | | | | | | | |
|---|---|---|---|---|---|---|---|---|---|---|
| | | Kaolin | SBR | PE | St-Zn | Paraffin | | | Dye | |
| | | | Melting point, etc. | | | | | | | |
| | | | Tg: −3° C. | 100° C. | 120° C. | 66° C. | 46° C. | | | |
| | | Particle size | | | | | | | | |
| | | 0.4μ | 0.4μ | | 0.6μ | 5.5μ | 0.3μ | 0.2μ | 0.5μ | Total |
| Composition No. | 1 | 25 | 10 | 20 | 3 | 1 | | | 12 | 71 |
| | 2 | 25 | 10 | 20 | | | 10 | | 12 | 77 |
| | 3 | 25 | 10 | 20 | | | | 4 | 12 | 71 |
| | 4 | 25 | 10 | 20 | | | | 10 | 12 | 77 |

In Table 1, values of the materials in the respective compositions represent the percentages by dry weight. As is known from Table 1, the materials in the respective compositions were, developer: 3,3'-diaryl-4,4'-dihydroxydiphenyl sulfone having the particle sizes of 0.4 μm, filler: kaolin having the particle sizes of 0.4 μm, binder: SBR having the glass transition temperature Tg of "−0.3° C.", and lubricants: polyethylene (PE) having the melting point of 100° C. and the particle sizes of 0.6 μm, zinc stearate (St-Zn) having the melting point of 120° C. and the particle sizes of 5.5 μm, paraffin having the melting point of 66° C. and the particle sizes of 0.3 μm, and paraffin having the melting point of 46° C. and the particle sizes of 0.2 μm. Further, the dye used was 2-aniline-3-methyl-6-(N-methyl-P-toluidine) fluoran having the particle sizes of 0.5 μm.

The developer, kaolin as the filler, SBR as the binder, and the dye were all added in equal amounts to the compositions No. 1 to No. 4.

The lubricants added to the composition No. 1 were polyethylene (PE) and zinc stearate. The lubricant added to the composition No. 2 was the paraffin having the melting point of 66° C. and the particle sizes of 0.3 μm. The lubricant added to the composition No. 3 was the paraffin having the melting point of 46° C. and the particle sizes of 0.2 μm. The lubricant added to the composition No. 4 was the same paraffin as the composition 3, which was, however, added to the composition No. 4 in a greater amount than the composition No. 3.

Liquid materials having the respective compositions were prepared for the thermosensitive recording layer, and then spread and dried on the OPP films. Pursuant to JIS: 8138, the inventor measured the opacities of up to the respective thermosensitive recording layers formed on the OPP films. Table 2 shows the measured opacities.

TABLE 2

| Composition No. | Opacity (%) |
|---|---|
| 1 | 25.6 |
| 2 | 19.2 |
| 3 | 16.6 |
| 4 | 14.9 |

As shown in Table 2, the composition No. 4 containing, as the lubricant, the paraffin having the melting point of 46° C. and the particle sizes of 0.2 μm in the largest amount resulted in the lowest opacity of 14.9%, meaning that this composition marked the highest transparency. On the contrary, the composition No. 1 containing, as the lubricant, polyethylene (PE) and zinc stearate, instead of the paraffin, resulted in the highest opacity of 25.6%, meaning that this composition marked the lowest transparency.

Two of the compositions were compared to each other; composition No. 2 containing, as the lubricant, the paraffin having the melting point of 66° C. and the particle sizes of 0.3 μm, and the composition No. 3 containing, as the lubricant, the paraffin having the melting point of 46° C. and the particle sizes of 0.2 μm. The comparison shows that the composition No. 2 resulted in the opacity of 19.2%, while the composition No. 3 resulted in the lower opacity of 16.6% than the composition No. 2. Thus, the composition No. 3 containing the paraffin having the lower melting point and smaller particle sizes favorably resulted in a higher transparency.

This may demonstrate that the paraffin having a lower melting point and smaller particle sizes serves to improve the transparency, because the low-melting paraffin is melted in the process of spreading and drying the liquid material for the thermosensitive recording layer on the substrate, and the melted paraffin penetrates into and fills gaps such as irreguralities of the surfaces of particles constituting the thermosensitive recording layer, effectively suppressing the diffuse reflection of light from the particle surfaces.

[Discussed Compositions of the Intermediate Layer]

Thus, the thermosensitive recording layer having the composition No. 4 favorably resulted in the lowest opacity. The real importance, however, lies in the opacity of the whole thermosensitive recording body in which the intermediate layer and the topcoat layer are formed on the thermosensitive recording layer.

Assuming the thermosensitive recording layer having the composition No. 3 that favorably resulted in the lower opacity than the composition No. 4, the inventor discussed binders to be added to the intermediate layer formed on this thermosensitive recording layer.

The liquid material for the thermosensitive recording layer having the composition No. 3 was mechanically applied so as to have the dry weight of 4.0 g/m$^2$. The opacity of up to the thermosensitive recording layer was 17.2%. Table 2 shows the opacity of up to the thermosensitive recording layer according to the composition No. 3 was 16.6%, which was different from the above-mentioned opacity. This is because the liquid material was manually applied in Table 2.

The inventor prepared four different liquid materials for the intermediate layer having compositions No. 5 to No. 8 containing the binders shown in Table 3. These liquid materials were spread on the thermosensitive recording layer having the composition No. 3 so as to have the dry weight of 1.8 g/m$^2$, and then dried to obtain different intermediate layers.

TABLE 3

| Composition No. | Binder | Opacity (%) | Water-proofness | Barrier properties |
|---|---|---|---|---|
| 5 | Core-shell acryl | 6.5 | good | good |
| 6 | Acryl | 9.6 | good | poor |
| 7 | PVA | 6.5 | poor | good |
| 8 | SBR | 7.8 | good | poor |
| Commercial product | — | 13.0 | — | — |

As shown in Table 3, the binders added to the compositions No. 5 to No. 8 were respectively a core-shell type acrylic resin, an acrylic resin, PVA, and SBR. Other than the binders, the same materials were used in these compositions.

The liquid materials having the respective compositions were prepared for the intermediate layer, and spread and dried on the thermosensitive recording layer having the composition No. 3. Pursuant to JIS: P8138, the inventor measured opacities of up to these intermediate layers.

Further, they were evaluated for waterproofness and barrier properties.

To evaluate waterproofness, the formed layers were immersed in tap water at 23° C. for 24 hours and visually checked whether their surfaces absorbed water and peeled off. The layers with no peeled-off part were evaluated as "good", whereas the layers with any peeled-off part were evaluated as "poor".

For barrier properties, two droplets of edible oil were dropped on the surfaces and left at rest at 40° C. for 15 hours. Then, it was visually checked whether what was printed thereon was gone. The layers with no missing print were evaluated as "good", whereas the layers with any missing print were evaluated as "poor". The evaluation result is shown in Table 3. Table 3 also shows the opacity evaluation of a thermosensitive recording sheet manufactured by other company. This thermosensitive recording sheet had a thermosensitive recording layer and an intermediate layer formed on an OPP film.

Table 3 shows that the opacities of up to the intermediate layers having the compositions No. 5 to No. 8 were lower than the opacity, 17.2%, of up to the thermosensitive recording layer. This may demonstrate that these intermediate layers conduce to improvements of the transparency.

In particular, the compositions No. 5 and No. 7 respectively containing, as the binder, the core-shell type acrylic resin and the water-soluble PVA both resulted in that opacities of up to the intermediate layers were the lowest opacity of 6.5%, meaning that these compositions could achieve a satisfactory transparency.

The composition No. 5 using the core-shell type acrylic resin was satisfactory in waterproofness and barrier properties, as well as in transparency.

The transparency is thus improved by forming the intermediate layers respectively containing, as the binder, the core-shell type acrylic resin and water-soluble PVA, because the core-shell type acrylic resin and water-soluble PVA have good film formation properties. In the process of spreading and drying the liquid material for the intermediate layer on the thermosensitive recording layer 3, the resin containing a water-soluble portion sinks into the thermosensitive recording layer 3, allowing the intermediate layer 4 formed to improve in smoothness. This may suppress the diffuse reflection of light from the thermosensitive recording layer 3.

[Discussed Compositions of the Topcoat Layer]

The inventor prepared liquid materials for seven different topcoat layers having the compositions No. 9 to No. 15 shown in Table 4, and two liquid materials A and B for general-use topcoat layers.

TABLE 4

| | | PE | | | St-Zn | | | acryl | Zr carbonate | Colloidal silica | | calcium carbonate | PMMA | PS | |
|---|---|---|---|---|---|---|---|---|---|---|---|---|---|---|---|
| | | Particle size | | | | | | | | | | | | | |
| | | 0.12μ | 0.6μ | 0.6μ | 0.1μ | 0.9μ | 5.5μ | | | a few nm | dozens of nm | 0.6μ | 2.6μ | 0.9μ | Total |
| Composition No. | 9 | | 10 | | | | | 50 | 5 | 15 | 30 | | | | 110 |
| | 10 | | | 10 | | | | 50 | 5 | 15 | 30 | | | | 110 |
| | 11 | | | | 10 | | | 50 | 5 | 15 | 30 | | | | 110 |
| | 12 | 10 | | | 5 | | | 50 | 5 | 15 | 30 | | | | 115 |
| | 13 | | | | | | 10 | 50 | 5 | 15 | 30 | | | | 110 |
| | 14 | 10 | | | | | | 50 | 5 | 15 | 30 | | | | 110 |
| | 15 | 10 | | | | | 5 | 50 | 5 | 15 | 30 | | | | 115 |
| | Topcoat material A | | | | | 13 | | 50 | 5 | | | 40 | 10 | | 118 |
| | Topcoat material B | | | 10 | | | | 40 | 2 | | | 30 | | 10 | 92 |

The values of the materials in the respective compositions represent the percentages by dry weight. As shown in FIG. 4, the lubricants used were polyethylene (PE) and zinc stearate (St-Zn).

Different types of polyethylene were used; one type of polyethylene having the particles sizes of 0.12 μm, and two types of polyethylene having the particles sizes of 0.6 μm. The two types of polyethylene having the particles sizes of 0.6 μm; polyethylene added to the composition No. 9, and polyethylene added to the composition No. 10 and the general-use topcoat layer B, were acquired from different manufacturers.

Different types of zinc stearate were used; zinc stearate having the particle sizes of 0.1 μm, zinc stearate having the particle sizes of 0.9 μm, and zinc stearate having the particle sizes of 5.5 μm.

An acrylic resin was used as the binder, and zirconium carbonate was used as the cross-linking agent.

The fillers used were colloidal silica having the particles sizes of a few nm, colloidal silica having the particle sizes of several dozen nm, calcium carbonate having the particle sizes of 0.6 μm, polymethyl methacrylate (PMMA) having the particles sizes of 2.6 μm, and polystyrene having the particles sizes of 0.9 μm.

To the seven compositions No. 9 to No. 15 were added equal amounts of the acrylic resin as the binder, zirconium carbonate as the cross-linking agent, and colloidal silicas respectively having the particles sizes of a few nm and several dozen nm as the filler. The lubricants alone were added in different amounts to these compositions.

The fillers added to the compositions of the two general-use topcoat layers A and B were calcium carbonate, polymethyl methacrylate (PMMA), and polystyrene. Neither of the colloidal silicas was added to these compositions.

Liquid materials having the compositions No. 9 to No. 15 were prepared for the topcoat layer. The prepared liquid materials were spread so as to have the dry weight of 1.5 g/m$^2$ on PET (polyethylene terephthalate) films having the thickness of 38 μm, and then dried. Then, the opacities of the topcoat layers obtained were measured pursuant to JIS: P8138.

As for the composition No. 15 of the seven compositions and the compositions of the topcoat layers A and B, the thermosensitive recording layer having the composition No. 3 was formed on OPP films as described in the discussed compositions of the intermediate layer. Then, the intermediate layer having the composition No. 5 was formed on the respective thermosensitive recording layers, and the liquid materials for the topcoat layer having the before-mentioned compositions were spread on the respective intermediate layers so as to have the dry weight of 1.5 g/m$^2$, and dried to form the topcoat layers. Then, the resulting opacities were measured. The liquid material for the thermosensitive recording layer was applied so as to have the dry weight of 4.0 g/m$^2$, and the liquid material for the intermediate layer was applied so as to have the dry weight of 1.8 g/m$^2$. Before the topcoat layers were formed, the opacity of up to the intermediate layer was 7.4%. The composition No. 5 shown in Table 3 resulted in that the opacity of up to the intermediate layer was 6.5%. This difference in opacity is associated with different methods of applying the liquid materials; whether they are mechanically or manually applied.

Further, the PET films coated with the topcoat layers made of the liquid materials having the compositions No. 13 to No. 15 lower in opacity, i.e., higher in transparency, were further evaluated for sticking resistance.

As for the evaluation of sticking resistance, the obtained films were printed by a printer, "HP-3600" supplied by Teraoka Seiko Co., Ltd., under the conditions; standard energy of 53% duty and printing speed of 100 mm/sec., and high energy of 80% duty and printing speed of 80 mm/sec. Then, the films were evaluated for surface distortion as follows; "good" for no surface distortion, "fair" for more or less surface distortion, and "poor" for more surface distortion than the films evaluated as fair.

Table 5 shows the evaluation results on opacity and sticking resistance.

TABLE 5

| Composition No. | PET 38μ/ topcoat | OPP 40μ/ thermosensitive/ intermediate/ topcoat | Sticking resistance (HP-3600) 100 mm/ S-53% | 80 mm/ s-80% |
|---|---|---|---|---|
| | Opacity (%) | | | |
| 9 | 8.3 | — | — | — |
| 10 | 11.6 | — | — | — |
| 11 | 10.8 | — | — | — |
| 12 | 7.6 | — | — | — |
| 13 | 8.4 | — | good | good |
| 14 | 2.8 | — | good/fair | poor |
| 15 | 4.8 | 6.9 | good | good |
| Topcoat material A | — | 16.0 | — | — |
| Topcoat material B | — | 20.0 | — | — |

Table 5 shows the opacity of each of the compositions No. 9 to No. 15 in which the topcoat layers were formed on PET films 38 μm in thickness and the opacity of each of the composition No. 15 and two general-use topcoat layers A and B in which the thermosensitive recording layers and the intermediate layers were formed on OPP films 40 μm in thickness, and then the topcoat layers were formed on the intermediate layers.

As for the compositions resulting in relatively high opacities, i.e., relatively poor transparencies and poor sticking resistance in the case where the topcoat layers were formed on the PET films, opacities in the case where these topcoat layers were formed on the intermediate layers were not measured.

Among the topcoat layers directly formed on the PET films having the thickness of 38 μm, the topcoat layers of the compositions No. 14 and No. 15 exhibited the low opacities of 2.8% and 4.8%, i.e., favorably high transparencies.

The topcoat layers having the compositions No. 13 to No. 15 were evaluated for sticking resistance as well, which revealed that the topcoat layer of the composition No. 14 exhibiting the highest transparency resulted in poor sticking resistance.

As for the composition No. 15, in which the thermosensitive recording layers and the intermediate layers were formed on the OPP films, and as for two general-use topcoat layers A and B, the opacity of the composition No. 15 favorably exhibited the low opacity of 6.9%. On the other hand, the opacities of the general-use topcoat layers A and B exhibited the high opacities of 16.0% and 20.0%, which were more than twice of the opacity obtained from the composition No. 15.

This may demonstrate that the composition No. 15 containing, as the filler, the colloidal silica having smaller particle sizes results in a higher transparency than the general-use topcoat layers A and B containing, as the filler, calcium carbonate, polymethyl methacrylate (PMMA), and/or polystyrene (PS) having greater particle sizes.

[Rediscussed Compositions of the Thermosensitive Recording Layer]

As described thus far, the composition No. 5 in Table 3 may preferably be selected for the intermediate layer in terms of transparency, waterproofness, and barrier properties. The compositions No. 13 and No. 15 in Table 4 may preferably be selected for the topcoat layer in terms of transparency and sticking resistance.

The intermediate layer having the composition No. 5 was formed on four thermosensitive recording layers having the compositions No. 1 to No. 4 in Table 1. Then, the topcoat layer having the composition No. 13 and the topcoat layer having the composition No. 15 were respectively formed on the intermediate layers, and evaluated for opacity and sticking resistance.

The liquid materials for the thermosensitive recording layer were spread on the OPP films so as to have the dry weight of 4.0 g/m$^2$. The liquid material for the intermediate layer was spread on the thermosensitive recording layers so as to have the dry weight of 1.8 g/m$^2$. The liquid materials for the topcoat layer were spread on the intermediate layers so as to have the dry weight of 1.5 g/m$^2$. The opacity measurement was performed upon completing the formation of each layer; thermosensitive recording layer, intermediate layer, and topcoat layer. The total thickness of the thermosensitive recording layer, intermediate layer, and topcoat layer, i.e., thickness from the bottom layer to the topcoat layer, exclusive of the OPP film, was approximately 7 μm.

Table 6 shows the evaluation results on opacity and sticking resistance.

TABLE 6

| Composition No. | Opacity (%) Thermosensitive recording layer | Intermediate layer | Topcoat layer (No. 13) | Topcoat layer (No. 15) | Sticking resistance (HP-3600) 100 mm/s-53% | 80 mm/s-80% |
|---|---|---|---|---|---|---|
| 1 | 25.6 | 7.5 | 10.6 | 7.4 | good | good |
| 2 | 19.2 | 9.0 | 9.9 | 9.0 | good | good |
| 3 | 16.6 | 7.4 | 8.4 | 7.3 | good | good |
| 4 | 14.9 | 8.3 | 9.4 | 8.0 | good | good |

As for the opacities of up to the thermosensitive recording layers, as shown in Table 6, the thermosensitive recording layer having the composition No. 4 marked the lowest opacity of 14.9%, while the thermosensitive recording layer having the composition No. 1 marked the highest opacity of 25.6%.

As for the opacities of up to the intermediate layer in the case where the intermediate layer having the composition No. 5 was formed on the thermosensitive recording layer, the thermosensitive recording layer having the composition No. 3 marked the lowest opacity of 7.4%, while the thermosensitive recording layer having the composition No. 2 marked the highest opacity of 9.0%. In both of these thermosensitive recording layers, the intermediate layer of the composition No. 5 formed thereon significantly lowered their opacities.

As for the opacities of up to the topcoat layer in the case where the topcoat layer having the composition No. 13 was formed on the intermediate layers, the thermosensitive recording layer having the composition No. 3 marked the lowest opacity of 8.4%, while the thermosensitive recording layer having the composition No. 1 marked the highest opacity of 10.6%.

As for the opacities of up to the topcoat layer in the case where the topcoat layer having the composition No. 15 was formed on the intermediate layers, the thermosensitive recording layer having the composition No. 3 marked the lowest opacity of 7.3%, while the thermosensitive recording layer having the composition No. 2 marked the highest opacity of 9.0%.

These thermosensitive recording layers were both satisfactory in sticking resistance.

It is known from these results that, by thus selecting the materials capable of suppressing the diffuse reflection of light to form the thermosensitive recording layer, intermediate layer, and topcoat layer, the opacity of up to the topcoat layer may be as low as substantially 10% or less, providing a thermosensitive recording body that may excel in transparency.

When the thermosensitive recording body according to this invention is bonded to a container of food as a label or a packaging film, the contents of the container may be visually checked through such a label or film that may excel in transparency.

The intermediate layer 4 formed in the embodiment described so far may be omitted, in which case a resin having a water-soluble portion, such as a core-shell type resin, may preferably be added to the topcoat layer 5.

Optionally, the thermosensitive recording body may have an anchor layer that increases adhesion between the substrate 2 and the thermosensitive recording layer 3, or any other suitable layer.

The invention claimed is:

1. A thermosensitive recording body, comprising at least a thermosensitive recording layer and a topcoat layer formed on a substrate, further comprising an intermediate layer between the thermosensitive recording layer and the topcoat layer wherein the substrate consists of a transparent film, the thermosensitive recording layer includes a paraffin, the topcoat layer includes a colloidal silica, and the intermediate layer includes a resin containing a water-soluble portion.

2. The thermosensitive recording body as claimed in claim 1, wherein the thermosensitive recording body, exclusive of the substrate, has a thickness greater than or equal to 1.0 μm and less than or equal to 10 μm, and the thermosensitive recording body has an opacity less than or equal to 10% pursuant to JIS: P8138.

3. The thermosensitive recording body as claimed in claim 2, wherein the paraffin is a paraffin having a melting point lower than or equal to a color developing temperature.

4. The thermosensitive recording body as claimed in claim 3, wherein the resin containing a water-soluble portion is a polyvinyl alcohol resin.

5. The thermosensitive recording body as claimed in claim 3, wherein the resin containing a water-soluble portion is a core-shell type resin.

6. The thermosensitive recording body as claimed in claim 2, wherein the resin containing a water-soluble portion is a polyvinyl alcohol resin.

7. The thermosensitive recording body as claimed in claim 2, wherein the resin containing a water-soluble portion is a core-shell type resin.

8. The thermosensitive recording body as claimed in claim 1, wherein the paraffin is a paraffin having a melting point lower than or equal to a color developing temperature.

9. The thermosensitive recording body as claimed in claim 8, wherein the resin containing a water-soluble portion is a polyvinyl alcohol resin.

10. The thermosensitive recording body as claimed in claim 8, wherein the resin containing a water-soluble portion is a core-shell type resin.

11. The thermosensitive recording body as claimed in claim 1, wherein the resin containing a water-soluble portion is a polyvinyl alcohol resin.

12. The thermosensitive recording body as claimed in claim 1, wherein the resin containing a water-soluble portion is a core-shell type resin.

* * * * *